US010519733B2

(12) United States Patent
Rosenthal et al.

(10) Patent No.: US 10,519,733 B2
(45) Date of Patent: Dec. 31, 2019

(54) SELF-BLEEDING SETTING TOOL AND METHOD

(71) Applicant: GEODYNAMICS, INC., Millsap, TX (US)

(72) Inventors: Wayne Rosenthal, Weatherford, TX (US); Jeremy Eli Castaneda, Weatherford, TX (US); Kevin George, Cleburne, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 16/072,082

(22) PCT Filed: Mar. 30, 2018

(86) PCT No.: PCT/US2018/025469
§ 371 (c)(1),
(2) Date: Jul. 23, 2018

(87) PCT Pub. No.: WO2019/089074
PCT Pub. Date: May 9, 2019

(65) Prior Publication Data

US 2019/0330945 A1 Oct. 31, 2019

Related U.S. Application Data

(60) Provisional application No. 62/580,538, filed on Nov. 2, 2017.

(51) Int. Cl.
*E21B 23/04* (2006.01)
*E21B 34/10* (2006.01)
*E21B 23/06* (2006.01)

(52) U.S. Cl.
CPC ..... *E21B 23/04* (2013.01); *E21B 23/06* (2013.01); *E21B 34/10* (2013.01)

(58) Field of Classification Search
CPC ..... E21B 23/04
USPC ..... 166/212
See application file for complete search history.

(56) References Cited

U.S. PATENT DOCUMENTS

| | | | | |
|---|---|---|---|---|
| 4,796,699 | A * | 1/1989 | Upchurch | E21B 23/04 166/250.17 |
| 4,817,725 | A | 4/1989 | Jenkins | |
| 5,845,669 | A | 12/1998 | Ross | |
| 6,349,771 | B1 | 2/2002 | Luke | |
| 2002/0033262 | A1 | 3/2002 | Musselwhite et al. | |

(Continued)

OTHER PUBLICATIONS

International Search Report and Written Opinion issued in related International Application No. PCT/US2018/025469, dated Mar. 30, 2018.

*Primary Examiner* — Taras P Bemko
(74) *Attorney, Agent, or Firm* — Patent Portfolio Builders PLLC

(57) ABSTRACT

A setting tool for setting an auxiliary tool in a well includes a housing having a floating piston that separates a pressure chamber from a hydraulic chamber; and a plug that is removably located in a through passage of the floating piston. The through passage fluidly connects the pressure chamber to the hydraulic chamber, and the plug prevents a fluid to move from the pressure chamber to the hydraulic chamber or from the hydraulic chamber to the pressure chamber when attached to the floating piston.

31 Claims, 11 Drawing Sheets

(56) References Cited

U.S. PATENT DOCUMENTS

| | | | | |
|---|---|---|---|---|
| 2007/0089911 | A1 | 4/2007 | Moyes | |
| 2011/0259607 | A1* | 10/2011 | Carisella | E21B 23/04 166/381 |
| 2012/0106297 | A1 | 5/2012 | Fraser | |
| 2013/0292137 | A1* | 11/2013 | Lauderdale | E21B 23/04 166/386 |
| 2014/0076536 | A1* | 3/2014 | Doane | E21B 23/04 166/156 |
| 2015/0315871 | A1* | 11/2015 | Fripp | E21B 23/06 166/374 |
| 2016/0168936 | A1 | 6/2016 | Carisella et al. | |
| 2016/0186513 | A1 | 6/2016 | Robertson et al. | |
| 2017/0107775 | A1* | 4/2017 | Maenza | E21B 23/04 |

* cited by examiner

SELF-BLEEDING SETTING TOOL AND METHOD

BACKGROUND

Technical Field

Embodiments of the subject matter disclosed herein generally relate to downhole tools for perforating well operations, and more specifically, to a self-bleeding setting tool used in a well for actuating various auxiliary tools.

Discussion of the Background

During well exploration, various tools are lowered into the well and placed at desired positions for plugging, perforating, or drilling the well. These tools are placed inside the well with the help of a conduit, as a wireline, electric line, continuous coiled tubing, threaded work string, etc. However, these tools need to be activated or set in place. The force needed to activate such a tool is large, for example, in excess of 15,000 lbs. Such a large force cannot be supplied by the conduit noted above.

A setting tool is commonly used in the industry to activate the tools noted above. Such a setting tool is typically activated by an explosive charge that causes a piston to be driven inside the setting tool. The movement of this piston is used for activating the various tools. A traditional setting tool 100 is shown in FIG. 1 and includes a firing head 102 that is connected to a pressure chamber 104. The firing head 102 ignites a primary igniter 103 that in turn ignites a power charge 106. Note that a secondary igniter may be located between the primary igniter and the power charge to bolster the igniting effect of the primary igniter.

A cylinder 110 is connected to a housing of the pressure chamber 104 and this cylinder fluidly communicates with the pressure chamber. Thus, when the power charge 106 burns, the large pressure generated inside the pressure chamber 104 is guided into the cylinder 110. A floating piston 112, which is located inside the cylinder 110, is pushed by the pressure formed in the pressure chamber 104 to the right in the figure. Oil 114, stored in a first chamber 115 of the cylinder 110, is pushed through a connector 116, formed in a block 118, which is located inside the cylinder 110, to a second chamber 120. Another piston 122 is located in the second chamber 120 and under the pressure exerted by the oil 114, the piston 122 and a piston rod 124 exert a large force on a crosslink 126. Crosslink 126 can move relative to the cylinder 110 and has a setting mandrel 128 for setting a desired tool (which was discussed above). Note that cylinder 110 has the end 130 sealed with a cylinder head 132 that allows the piston rod 124 to move back and forth without being affected by the wellbore/formation pressure.

After the setting tool has been set, it needs to be raised to the surface and be reset for another use. Because the burning of the power charge 106 has created a large pressure inside the pressure chamber 104, this pressure needs to be relieved, the pressure chamber needs to be cleaned from the residual explosive and ashes, and the pistons and the oil (hydraulic fluids) need to be returned to their initial positions.

Relieving the high pressure formed in the pressure chamber 104 is not only dangerous to the health of the workers performing this task, because of the toxic gases left behind by the burning of the power charge, but is also a safety issue because the pressure in the pressure chamber is high enough to injure the workers if its release is not carefully controlled. In this regard, note that the traditional setting tool 100 has a release valve 140 that is used for releasing the pressure from inside the pressure chamber. However, when the release valve 140 is removed from cylinder 100, due to the high pressure inside the cylinder, the release valve may behave like a projectile and injure the person removing it. For this reason, a dedicated removing procedure has been put in place and also a safety sleeve is used to cover the release valve, when at the surface, for relieving the pressure from the setting tool.

However, this procedure is cumbersome, time consuming and still, if a person misses any detail of the procedure, that person can get hurt by the release valve. Thus, there is a need to release the accumulated pressure inside the cylinder in a way that is quick and poses no harm to the person performing this action.

SUMMARY

According to an embodiment, there is a setting tool for setting an auxiliary tool in a well. The setting tool includes a housing having a floating piston that separates a pressure chamber from a hydraulic chamber and a plug that is removably located in a through passage of the floating piston. The through passage fluidly connects the pressure chamber to the hydraulic chamber. The plug prevents a fluid to move from the pressure chamber to the hydraulic chamber or from the hydraulic chamber to the pressure chamber when attached to the floating piston.

According to another embodiment, there is a method for bleeding off a pressurized gas from a setting tool while the setting tool is located in a well. The method includes lowering the setting tool into the well; actuating the setting tool with the pressurized gas; moving a floating piston inside a housing of the setting tool, wherein the floating piston separates a pressure chamber from an hydraulic chamber, the pressure chamber housing the pressurized gas; removing a plug that is removably located in a through passage of the floating piston; and bleeding off the pressurized gas from the setting tool to an inside of the well.

According to still another embodiment, there is a downhole tool for setting an auxiliary tool. The downhole tool includes a floating piston having a through passage, a plug that blocks the through passage and the plug is removably attached to the floating piston, and a brace rod having an upstream arm having an external diameter equal to or smaller than an external diameter of a portion of the plug that contacts the upstream arm.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a setting tool. However, the embodiments discussed herein are also applicable to any tool in which a high-pressure is generated and then that high-pressure needs to be released outside the tool.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
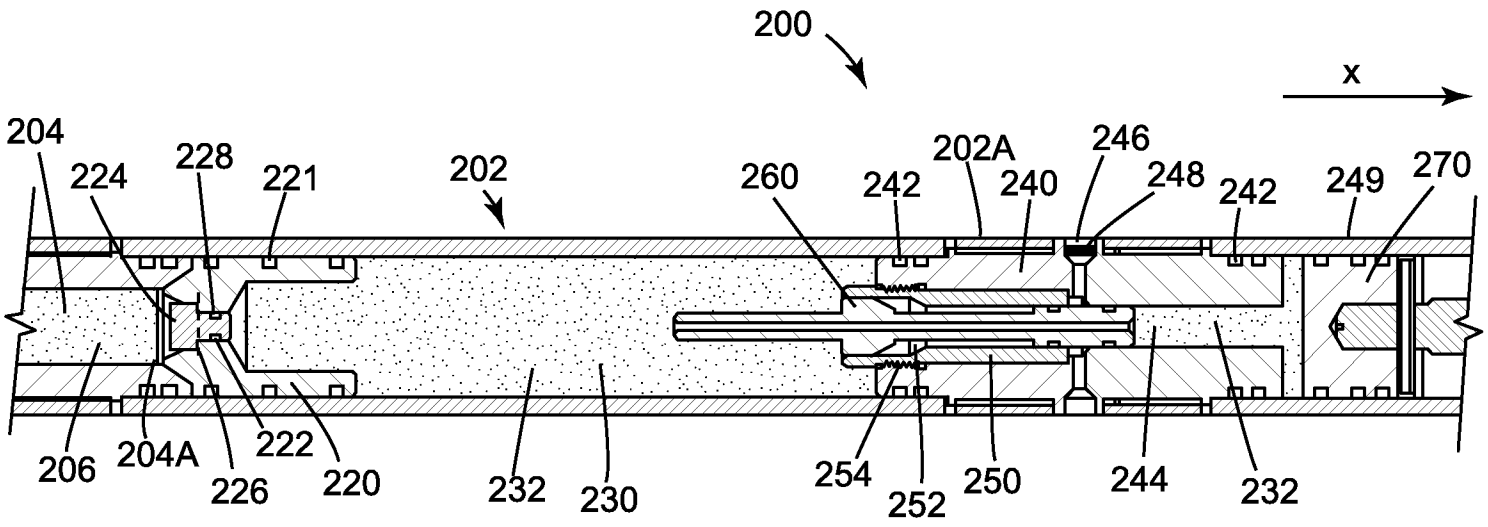
FIG. 2 illustrates a new setting tool that is configured to bleed off the pressurized gas inside the well.

According to an embodiment, a self-bleeding setting tool has a floating piston that can be reconfigured while in the well to allow fluid communication between a chamber under pressure and a venting port formed in the setting tool, downstream of the floating piston. More specifically, FIG. 2 shows a setting tool 200 having a housing 202 that hosts a pressure chamber 204. A downstream end 204A of the pressure chamber 204 (in the discussion herein, the term "downstream" is understood to indicate a direction toward the end of the well, irrespective of whether the well is vertical or horizontal and the term "upstream" is understood to indicate a direction toward the surface head of the well) is closed by a floating piston 220. Note that one or more O-rings 221 may be placed around the floating piston 220, facing the housing 202, for sealing an interface between the piston and the housing.

Figure 3:
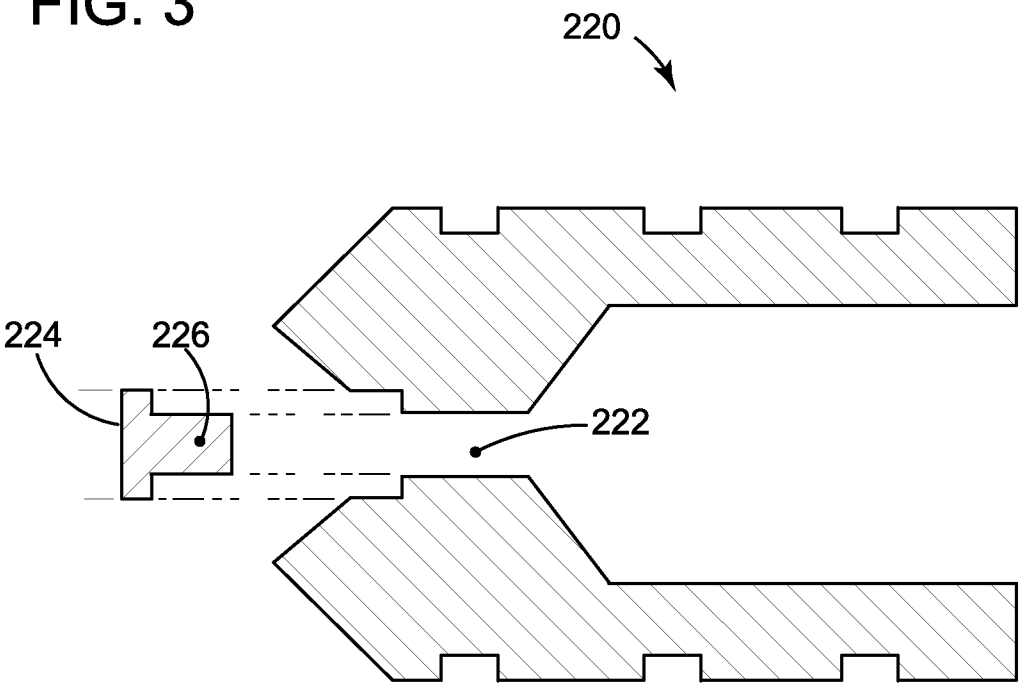
FIG. 3 illustrates a floating piston having a plug for the new setting tool.

Floating piston 220 is shown in FIG. 3 and has a longitudinal passage 222 that allows the gas from the pressure chamber 204 to move to a hydraulic chamber 230 (see FIG. 2), which holds a given amount of oil or a similar hydraulic fluid. However, as shown in FIG. 2, the passage 222 is closed by a plug 224, which is shown in FIG. 3 being removed from the floating piston 220. The plug 224 is removably attached to the floating piston 220 with one or more breakable pins 226 (see FIGS. 2 and 3). Thus, when the setting tool is deployed in the well as shown in FIG. 2, the plug 224 blocks the passage 222 of the floating piston 220 so that gas 206 cannot enter the hydraulic chamber 230 and oil 232 cannot enter pressure chamber 204. FIG. 2 also shows plug 224 to have a groove 228 in which an O-ring may be placed to ensure the sealing of the passage 222.

Returning to FIG. 2, floating piston 220 separates the pressure chamber 204 from the hydraulic chamber 230 and thus, it separates the gas 206 from the oil 232. A block 240 is placed partially inside the housing 202, at its end 202A, so that the hydraulic chamber 230 is sealed from the well fluid (fluid outside the housing 202). Note that in this embodiment, block 240 partially enters inside the cylinder head 249. One or more O-rings 242 are placed between the block 240 and the housing 202 to prevent the oil from escaping the hydraulic chamber 230. Block 240 has an internal conduit 244 that extends along an entire length of the block along a longitudinal axis X. Block 240 also have one or more venting ports 246 that communicate at one end with the ambient of the setting tool and at the other end with an interior of the conduit 244. Venting port 246 may be open or it may host a bleeding mechanism 248 that will be discussed later.

An insert 250 having a shoulder 252 is placed partially inside the conduit 244 formed in the block 240. In one application, the insert 250 is attached to the inside of the conduit 244 with threads 254. Other methods may be used for attaching the insert to the conduit 244. The insert 250 is attached to the conduit 244 so that the insert does not move relative to the block 240 when the oil 232 inside the hydraulic chamber 230 is pressurized. Insert 250 has an internal bore 256 (see FIG. 4) that extends along the entire insert along the longitudinal axis X. Internal bore 256 may have an upstream part 256A having a first diameter 256A-1 and a downstream part 256B having a second diameter 256B-1. The first diameter is larger than the second diameter. A transition between the two diameters is provided by the shoulder 252.

Figure 4:
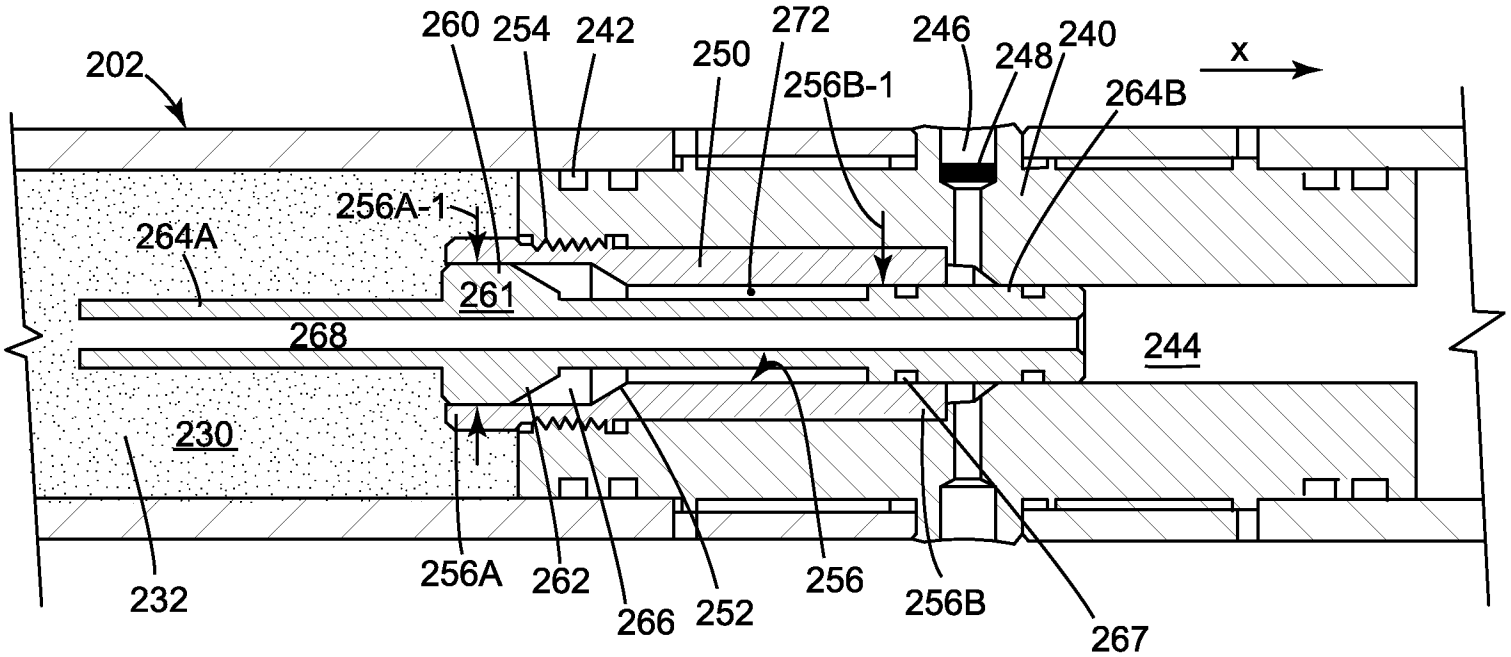
FIG. 4 illustrates new components for the new setting tool.

A brace rod 260 is sized to fit inside the insert 250 as illustrated in FIGS. 2 and 4. FIG. 4 shows the brace rod 260 having a central part 261 that fits tightly inside the upstream part 256A of the insert 250. Brace rod 260 has a shoulder 262 that is configured to mate with shoulder 252 of the insert 250. Brace rod 260 has an upstream arm 264A and a downstream arm 264B. The upstream arm 264A extends into the hydraulic chamber 230 while the downstream arm 264B extends through the insert 250 into the conduit 244 of the block 240. The upstream arm has an external diameter that is equal to or smaller than an external diameter of a portion of the plug 224 that faces the upstream arm, so that the upstream arm can remove (break off) the plug 224 from the floating piston when the floating piston is pressed by the upstream arm.

FIG. 4 shows the shoulder 262 of the brace rod 260 defining a space 266 with the shoulder 252 of the insert 250. Also, FIG. 4 shows that one or more grooves 272 are formed along the central part 261 and the downstream portion 264B of the brace rod 260 so that the oil 232 from the hydraulic chamber 230 can travel toward the venting port 246 when a predetermined condition is met. As shown in FIG. 4, the groove 272 is not in fluid communication with the venting port 246 as the predetermined condition has not yet met. In one application, the predetermined condition is that shoulder 262 touches shoulder 252 so that space 266 has vanished. This case is discussed later with regard to FIG. 6. For the configuration shown in FIGS. 2 and 4, the oil 232 from the hydraulic chamber 230 cannot reach the venting port 246 because the most distal part of the downstream arm 264B blocks groove 272. In this regard, note that an O-ring seal 267 is located between the groove 272 and the venting port 246.

Brace rod 260 has an internal passage 268 that extends all the way through the brace rod, so that the oil 232 from the hydraulic chamber 230 can move to the conduit 244 to act on the piston 270 (see FIG. 2). Piston 270 then acts on an adjacent (or auxiliary) tool to actuate that tool.

Figure 5:
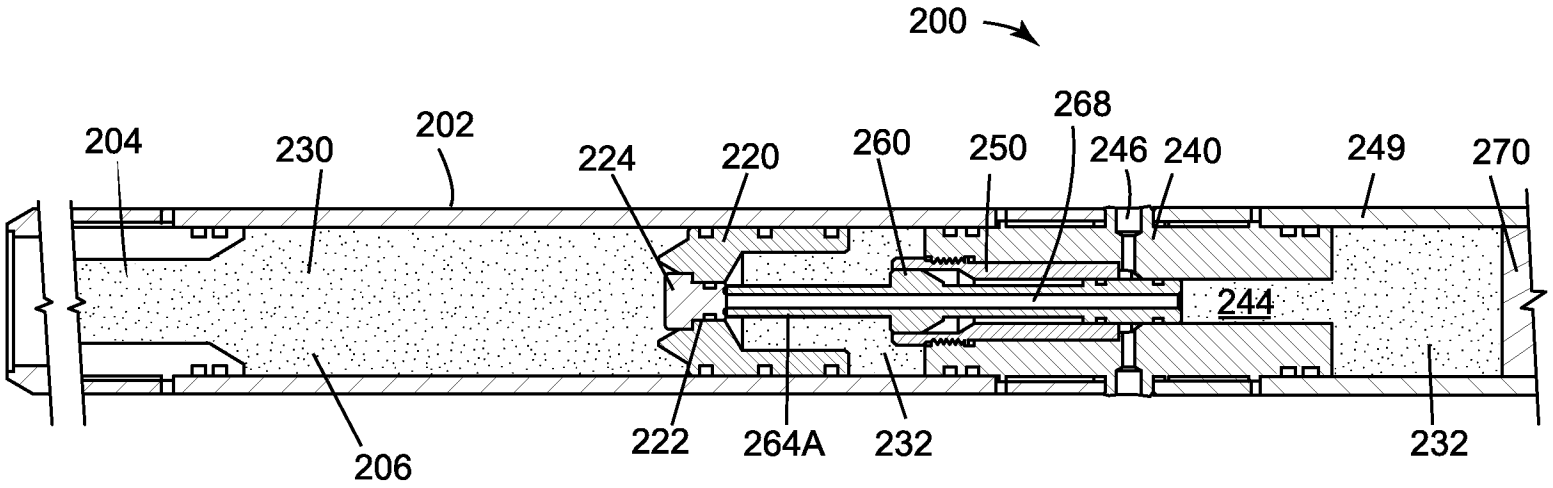
FIG. 5 illustrates an intermediate stage of the setting tool during its actuation.

When in use, various components of the setting tool illustrated in FIG. 2 move relative to the housing 202 as now discussed. For the purpose of this discussion, it is assumed in this embodiment that the power charge in the pressure chamber 204 has burned and the formed gas 206, having a high pressure, is pushing the floating piston 220 towards the brace rod 260 as illustrated in FIG. 5. One skilled in the art would understand that other mechanisms may be used for generating the high pressure gas 206, for example, pumping the gas from the head of the well or using an accumulator attached or hosted by the setting tool.

As a consequence of the movement of the floating piston 220, the oil 232 from the hydraulic chamber 230 moves through internal passage 268 of the brace rod 260, into the conduit 244 and cylinder head 249, which results in the movement of the piston 270 and subsequent actuation of an auxiliary tool (not shown), for example, a frac-plug, bridge-plug, or other packers. Note that while the floating piston 220 is moving towards the brace rod 260, the plug 224 remains attached to the piston 220 so that the passage 222 is blocked. Further, FIG. 5 illustrates the exact moment when the upstream portion 264A of the brace rod 260 is touching the plug 224. Thus, at this point, the oil 232 trapped between the floating piston 220 and the brace rod 260 cannot escape along internal passage 268.

Figure 6:
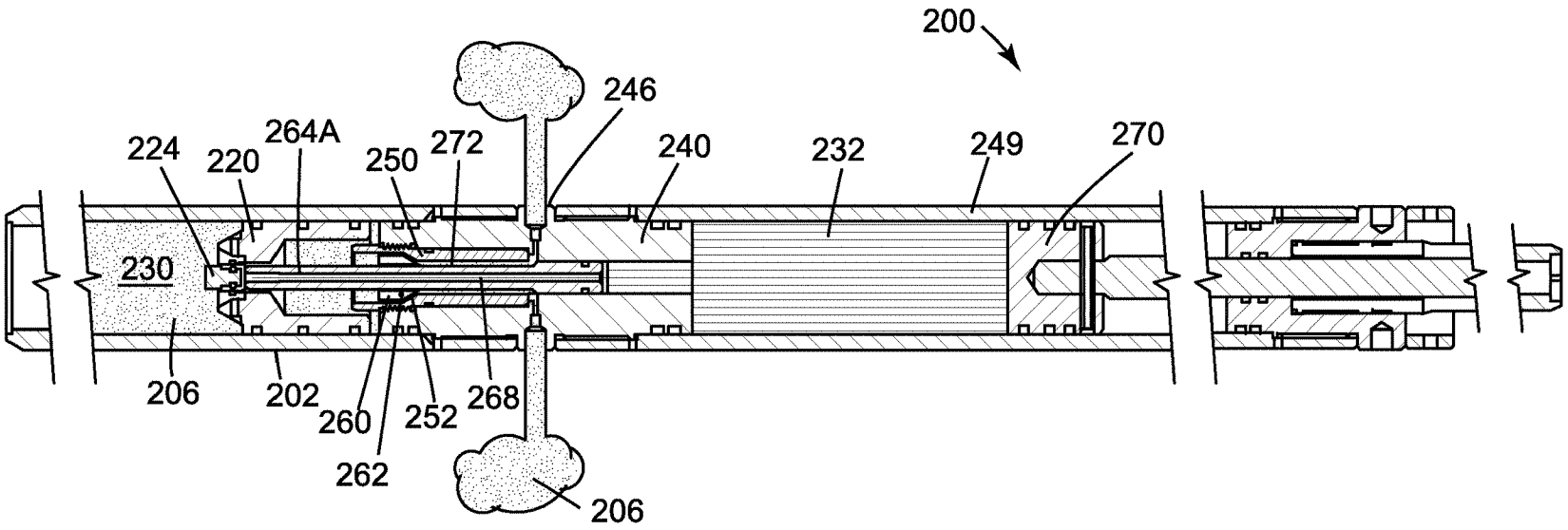
FIG. 6 illustrates a final stage of the setting tool at the end of its actuation.

However, this situation is only temporary because, due to the high pressure of the gas 206, the floating piston 220 still continues to move toward the insert 250. Because the floating piston is now in contact with the brace rod (see FIG. 5), the floating piston's movement pushes the brace rod 260 closer to the insert 250. This displacement of the brace rod 260 continues until the brace rod's shoulder 262 touches insert 250's shoulder 252, as illustrated in FIG. 6. This is the predetermined condition previously discussed for making the groove 272 to fluidly communicate with the venting port 246, as shown in FIG. 6.

At this time, because the brace rod 260 cannot move further toward the insert 250, and because the floating piston 220 is still pressing on the upstream portion 264A of the brace rod 260, the plug 224 is broken off from the floating piston 220. Thus, the removal of the plug 224 from the floating piston 220 opens up the internal passage 268 of the brace rod 260, which allows the pressurized gas 206 to move along one or more longitudinal grooves 272 to the venting port 246 and escape in the ambient of the setting tool 200, i.e., to self-bleed inside the well. As previously discussed, the venting port 246 may be open to the ambient, in which case no additional step is necessary for venting out the gas 206.

Figure 1:
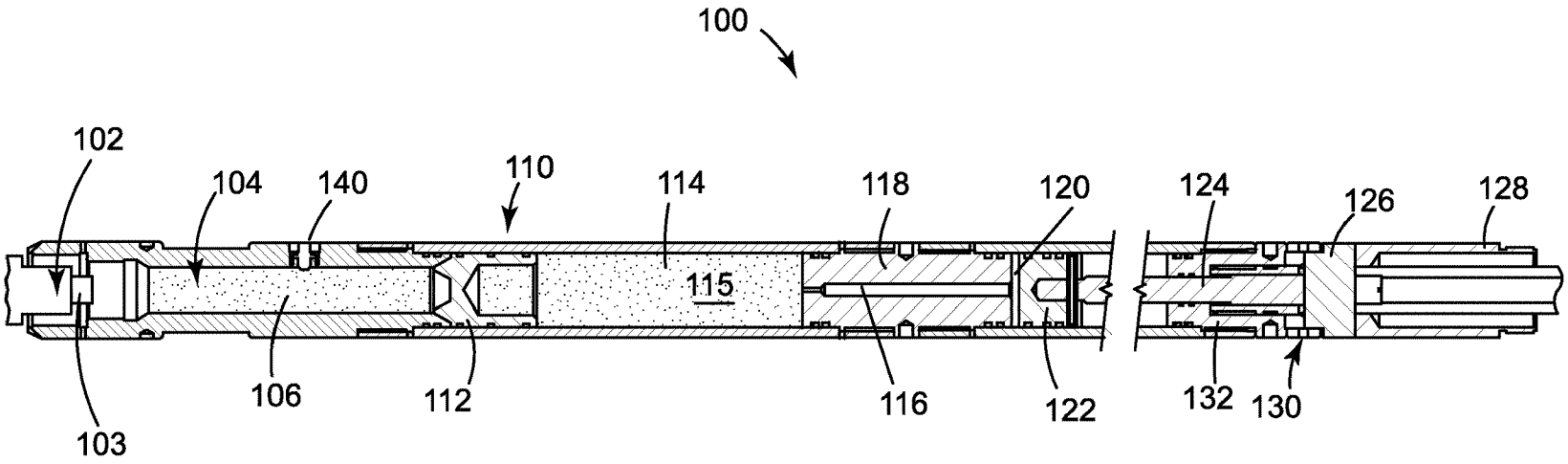
FIG. 1 Background Art
FIG. 1 illustrates a traditional setting tool that needs to be retrieved to the surface for removing pressurized gas from inside.
Figure 7A:
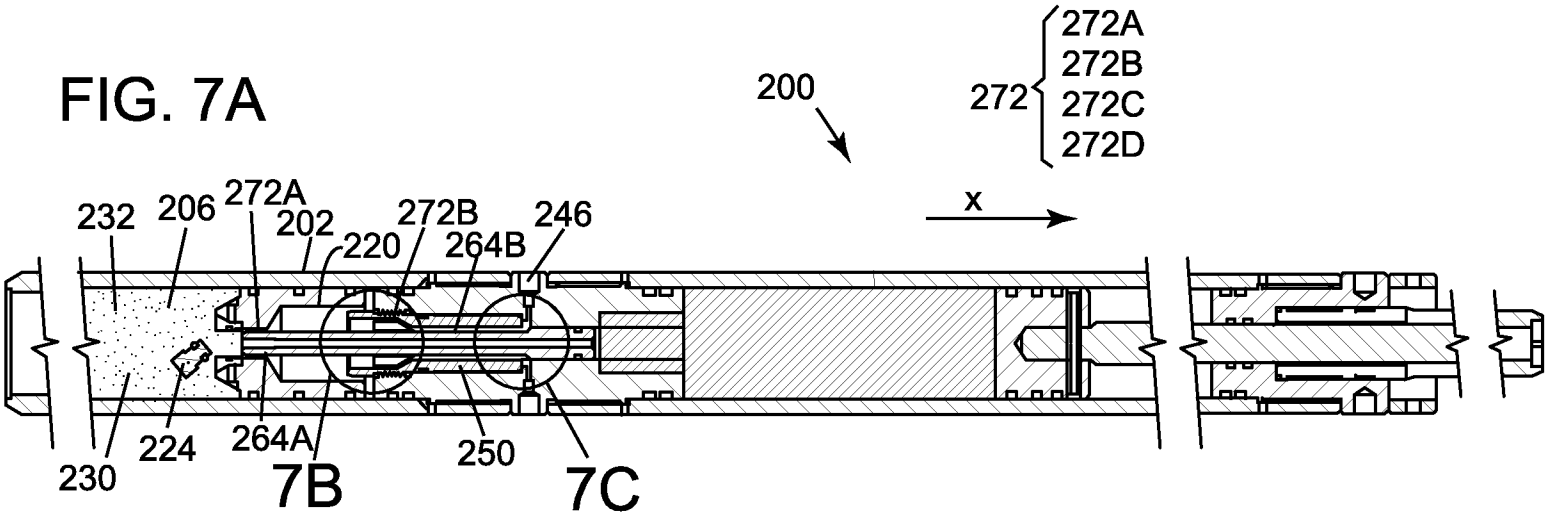
FIGS. 7A to 7D illustrate various details associated with a groove that allows the pressurized gas inside the setting tool to reach a venting port.
Figure 7C:
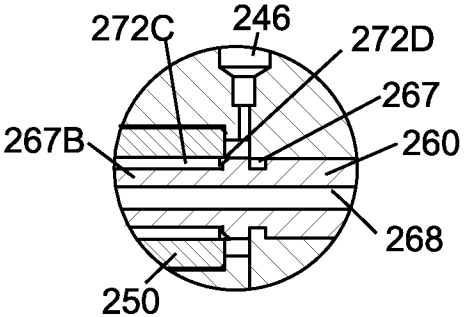
Figure 7B:
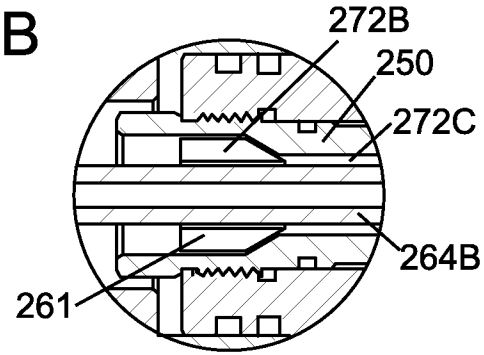
Figure 7D:
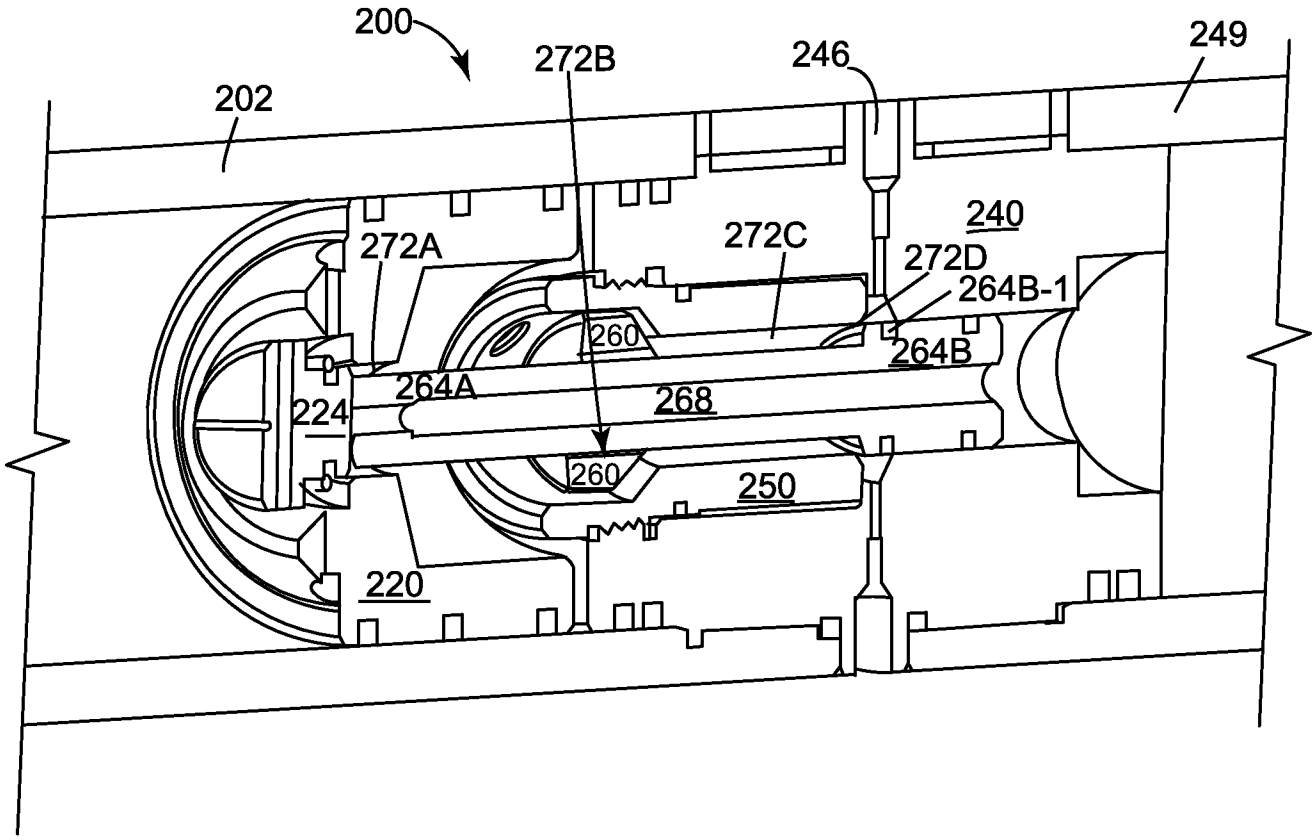

The groove 272 is shown in more detail in FIGS. 7A to 7C. Note that groove 272 has four parts, 272A to 272D. FIG. 7A shows the first part 272A of the groove 272 extending along the X axis, between the internal bore 222 of the floating piston 220 and the upstream portion 264A of the brace rod 260. The second part 272B of the groove 272 also extends along the longitudinal axis X, through the central part 261 of the brace rod 260, as shown in FIGS. 7A and 7B. The third part 272C of the groove 272 also extends along the longitudinal axis X, in the body of the downstream portion 264B of the brace rod 260, and facing the insert 250, as shown in FIGS. 7A to 7C. The fourth part 272D of the groove 272 is shown in FIGS. 7A and 7C and connects the third part 272C to the venting port 246. The fourth part 272D opens up only when the distal part of the downstream arm 264B of the brace rod 260 has moved past the venting part 246, as shown in FIGS. 7C and 7D. Note that prior to reaching this position, the O-ring 264B-1 (see FIG. 7D) has blocked the third part 272C of the groove 272 from fluidly communicating with the venting port 246. Also note that the venting port 246 is formed in this embodiment through the body of the block 240, which is different from the setting tool shown in FIG. 1, where the venting port 140 is formed in the pressure chamber 104. If plural venting ports 246 are present, as shown in FIG. 7D, then plural such groove 272 may be formed along the brace rod 260 to have a groove for each venting port.

With such configuration, the pressurized gas 232 present in the hydraulic chamber 230 (see FIG. 6) is now able to escape (bleed) along the parts 272A to 272D (see also FIG. 7D that shows a 3D representation of the setting tool) of groove 272, to venting port 246 and dissipate into the well. FIG. 6 shows the pressurized gas 206 escaping outside the setting tool. Note that the pressurized gas would also expel the portion of oil present inside the floating piston 220. This way of removing the pressurized gas directly into the well ensures the safety of the personnel operating the setting tool, and also makes the operation automatic and quick.

Figure 8:
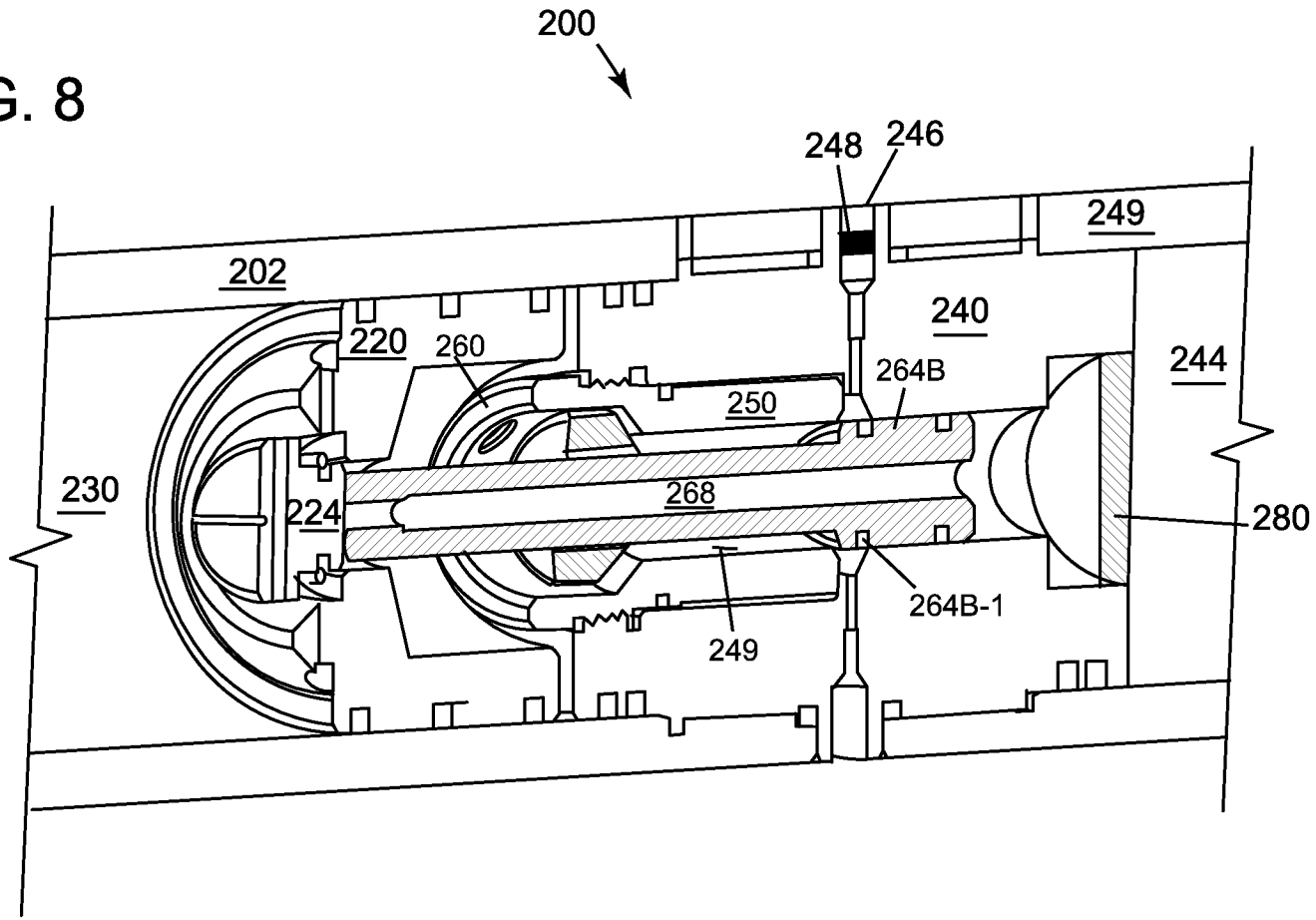
FIG. 8 is a 3D view of an inside of the novel setting tool.

In another embodiment, the venting port 246 is not open to the ambient as shown in FIGS. 7A to 7D, but is rather closed with a bleeding mechanism 248 as illustrated in FIG. 8. Bleeding mechanism 248 may be a rupture disc that is manufactured to break at a given pressure. Thus, if the pressure at which the rupture disc breaks is selected to be the pressure of the gas 206 after the floating piston 220 has reached its final position, then the rupture disc would be broken by the gas 206. In another embodiment, the pressurized gas 206 may not have enough pressure to break the rupture disc 248. If this is the case, it is possible to increase the pressure of gas 206 by pumping air from the surface until the rupture disc breaks into pieces.

According to another embodiment, it is possible to have a cutting element 249, see FIG. 8, that cuts the O-ring 264B-1 of the downstream arm 264B when the brace rod 260 moves relative to the housing 202, so that the third part 272C of the groove 272 communicates with the fourth part 272D and with the venting port 246. Still with regard to FIG. 8, it is possible to have, instead or in addition of the cutting element 249, a shut off valve 280 installed in the conduit 244 to allow the oil from the hydraulic chamber 230 to pass into the conduit 244, but the valve would prevent the oil in the conduit 244 to move back into the hydraulic chamber 230 and then to bleed off along the groove 272 into the venting port 246.

Figure 9:
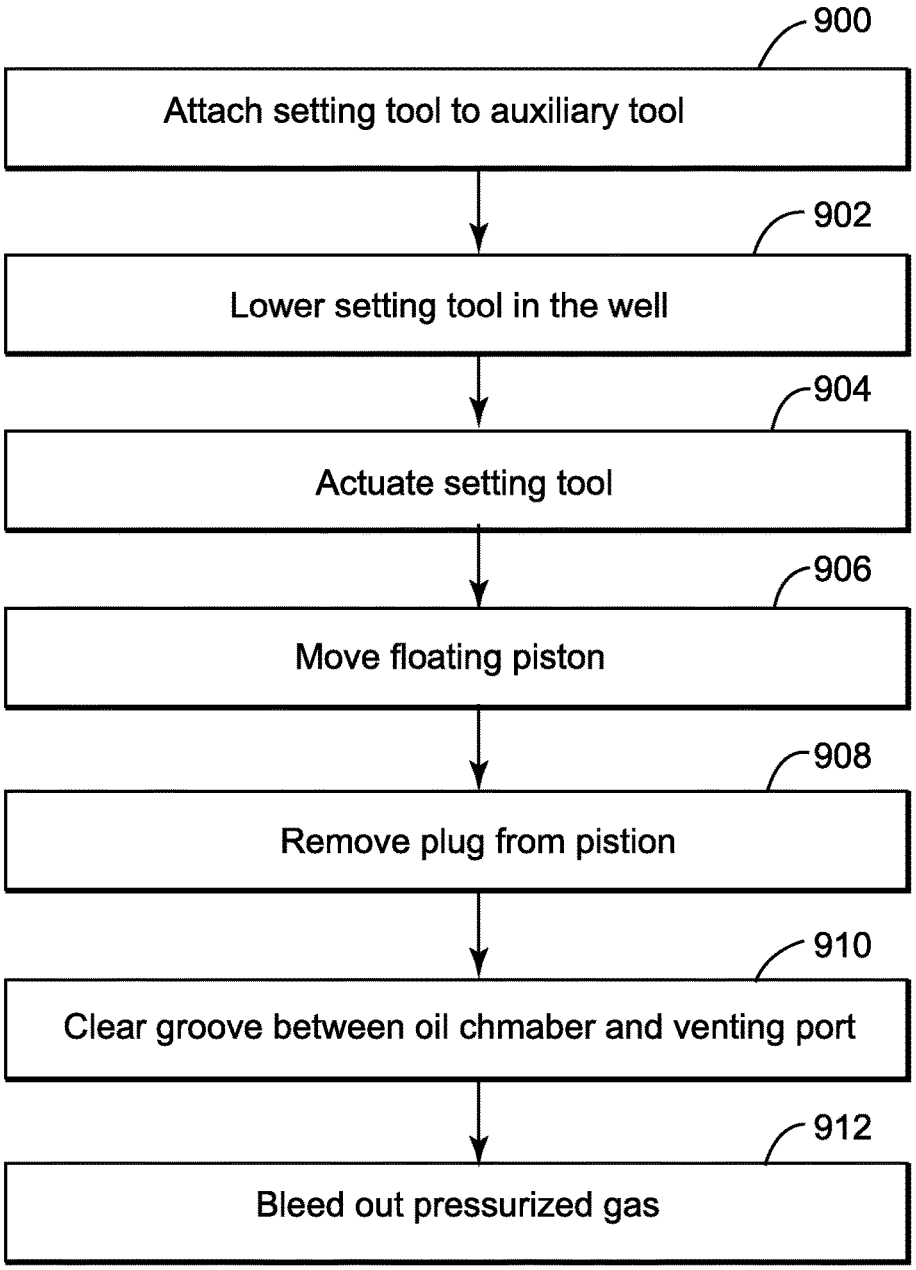
FIG. 9 is a flowchart of a method for actuating the setting tool.

A method for bleeding off a setting tool as illustrated above is now discussed with regard to FIG. 9. FIG. 9 shows that in step 900, a setting tool 200 is attached to an auxiliary tool (e.g., plug) and in step 902 the setting tool and the auxiliary tool are lowered into the well. In step 904, the setting tool 200 is actuated by a pressurized gas. The pressurized gas can, for example, be generated by burning a power charge as discussed in the embodiment illustrated in FIG. 2. Other mechanisms may be used for generating the pressurized gas. In step 906, the pressurized gas moves the floating piston 220 to actuate the auxiliary tool. In step 908, a plug 224 of the floating piston 220 is removed and in step 910 a groove 272 between a hydraulic chamber and a venting port 246 is opened up. In step 912, the pressurized gas is bled outside the setting tool through the groove 272. This step takes place inside the well without human intervention.

Figure 10:
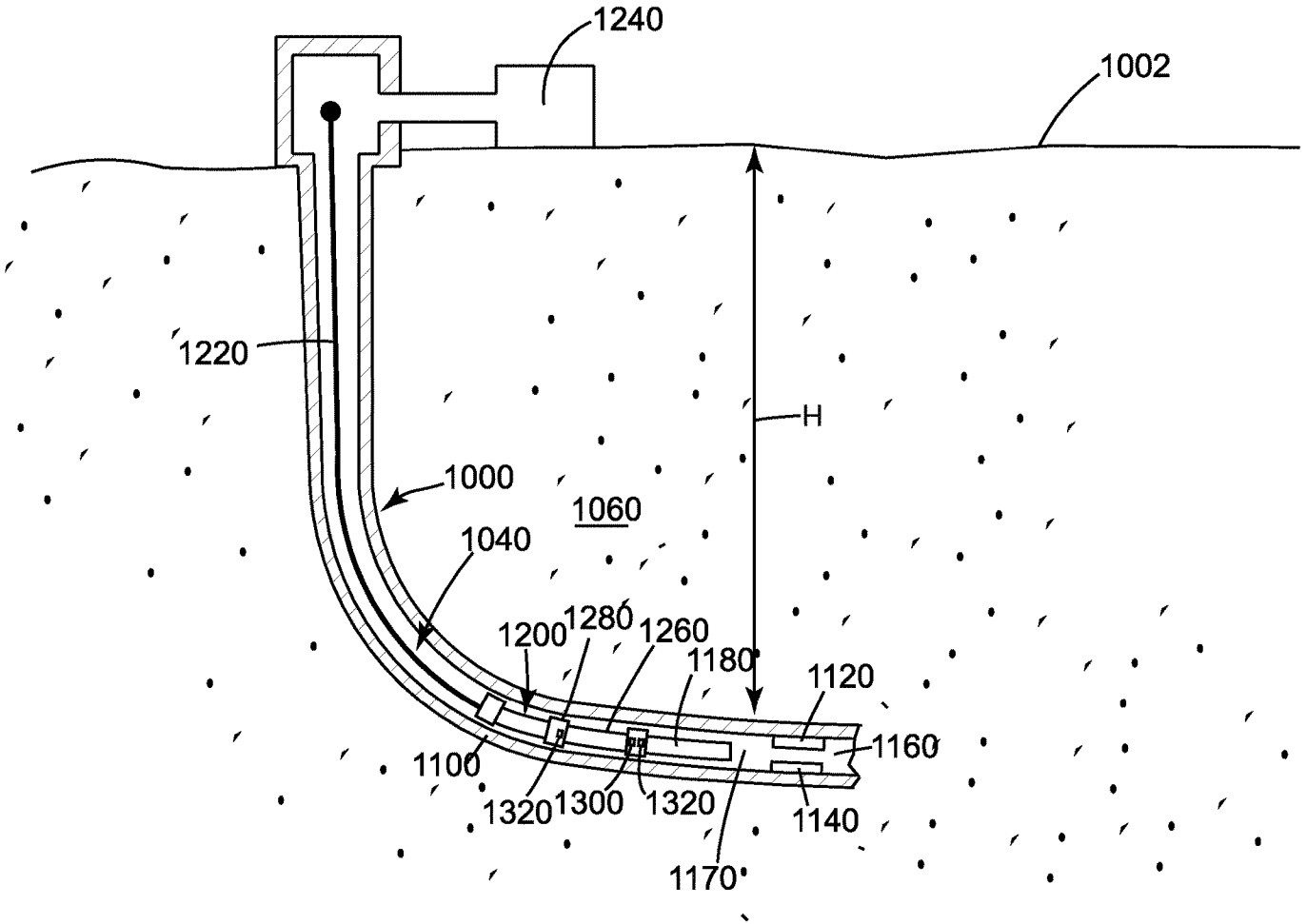
FIG. 10 illustrates a well and associated equipment for well completion operations.

The setting tool 200 discussed in the previous embodiments may be used in a well as illustrated in FIG. 10. FIG. 10 shows a well 1000 that was drilled to a desired depth H relative to the surface 1002. A casing string 1100 protecting the wellbore 1040 has been installed and cemented in place.

To connect the wellbore 1040 to a subterranean formation 1060 to extract the oil and/or gas, a plug 1120 needs to be set up in the well.

The typical process of connecting the casing to the subterranean formation may include the following steps: (1) connecting the plug 1120 with a through port 1140 (known as a frac plug) to a setting tool, (2) lowering the setting tool and the plug into the well, (3) setting up the plug, and (4) perforating a new stage 1170 above the plug 1120. The step of perforating may be achieved with a gun string 1200 that is lowered into the well with a wireline 1220. A controller 1240 located at the surface controls the wireline 1220 and also sends various commands along the wireline to actuate one or more gun assemblies of the gun string or a setting tool 1180, which is attached to the most distal gun assembly.

A traditional gun string 1200 includes plural carriers 1260 connected to each other by corresponding subs 1280, as illustrated in FIG. 10. Each sub 1280 includes a detonator 1300 and a corresponding switch 1320. The corresponding switch 1320 is actuated by the detonation of a downstream gun. When this happens, the detonator 1300 becomes connected to the through line, and when a command from the surface actuates the detonator 1300, the upstream gun is actuated. When the most distal detonator is actuated, the power charge from the setting tool 1180 is ignited and the setting tool is actuated. The setting tool 1180 is engaged to an auxiliary tool 1120 (e.g., a plug in this embodiment) when the detonator is actuated. After the setting tool has been activated, and the pressurized gas has set up the plug 1120, the pressurized gas from the setting tool is bled into the well, as discussed above with regard to the embodiment illustrated in FIG. 9. After this or at the same time the setting tool 1180 is retrieved from the plug 1120 as illustrated in FIG. 10, the operator of the gun string can start the fracturing process.

The setting tool discussed above may be manufactured as illustrated in the previous figures. However, one skilled in the art would understand that the novel features shown in the above figures may also be implemented retroactively into the existing setting tools. Thus, in one embodiment, the floating piston of a traditional setting tool may be replaced with the floating piston 220 shown in FIG. 3 so that there is a bore through the piston and the bore is capped with a plug 224. Further, a traditional setting tool may be modified to receive insert 250 and brace rod 260, which are shown in FIG. 2. Also note that the novel setting tool 200 shown in FIG. 2 may still include the release valve 140 provided at the pressure chamber 204, similar to the traditional setting tool 100 shown in FIG. 1. However, one skilled in the art would understand that the release valve 140 may be removed in the setting tool 200.

The disclosed embodiments provide methods and systems for automatically bleeding off a pressurized gas from a setting tool while located in a well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A setting tool for setting an auxiliary tool in a well, the setting tool comprising:

a housing having a floating piston that separates a pressure chamber from a hydraulic chamber; and a plug that is removably located in a through passage of the floating piston, wherein the through passage fluidly connects the pressure chamber to the hydraulic chamber, and wherein the plug prevents a fluid to move from the pressure chamber to the hydraulic chamber or from the hydraulic chamber to the pressure chamber when attached to the floating piston.

2. The setting tool of claim 1, further comprising:

a block that closes an end of the housing, the block having a through conduit and a venting port that connects the conduit to an exterior of the housing.

3. The setting tool of claim 2, further comprising:

a breaking disc formed inside the venting port.

4. The setting tool of claim 2, further comprising:

an insert placed inside the conduit of the block.

5. The setting tool of claim 4, further comprising:

a brace rod movably located inside the insert.

6. The setting tool of claim 5, wherein the brace rod has an upstream arm and a downstream arm, the upstream arm extends into the hydraulic chamber and has an external diameter that is equal to or smaller than a diameter of the plug, and the downstream arm extends into the conduit of the block.

7. The setting tool of claim 5, wherein the brace rod has a longitudinal groove.

8. The setting tool of claim 7, wherein the groove is not in fluid communication with the venting port when the plug is attached to the floating piston.

9. The setting tool of claim 7, wherein the groove is in fluid communication with the venting port after the floating piston has pushed the brace rod towards the insert.

10. The setting tool of claim 7, wherein the plug shears off from the floating piston due to the brace rod.

11. The setting tool of claim 10, wherein a pressurized gas from the pressure chamber bleeds off through the venting port after the plug was removed from the floating piston.

12. The setting tool of claim 7, further comprising:

a cutting element attached to the insert for slicing an o-ring attached to the brace rod for opening the groove.

13. A method for bleeding off a pressurized gas from a setting tool while the setting tool is located in a well, the method comprising:

lowering the setting tool into the well;

actuating the setting tool with the pressurized gas;

moving a floating piston inside a housing of the setting tool, wherein the floating piston separates a pressure chamber from an hydraulic chamber, the pressure chamber housing the pressurized gas;

removing a plug that is removably located in a through passage of the floating piston; and bleeding off the pressurized gas from the setting tool to an inside of the well.

14. The method of claim 13, wherein the through passage fluidly connects the pressure chamber to the hydraulic chamber, and wherein the plug prevents a fluid to move from the pressure chamber to the hydraulic chamber or from the hydraulic chamber to the pressure chamber when attached to the floating piston.

15. The method of claim 13, wherein the step of removing comprises:

displacing a brace rod, which is movably located inside an insert, so that a longitudinal groove formed along the brace rod fluidly communicates with a venting port formed in a block that closes the housing.

16. The method of claim 15, wherein the groove is not in fluid communication with the venting port when the plug is attached to the floating piston.

17. The method of claim 15, wherein the groove is in fluid communication with the venting port after the floating piston has pushed the brace rod towards the insert.

18. The method of claim 15, wherein the brace rod has an upstream arm and a downstream arm, the upstream arm extends into the hydraulic chamber and matches a diameter of the plug, and the downstream arm extends into a conduit of a block.

19. The method of claim 15, further comprising:

shearing off the plug from the floating piston with the brace rod.

20. The method of claim 13, wherein the step of bleeding off comprises:

releasing into the well the pressurized gas from the pressure chamber, through a venting port, after the plug is removed from the floating piston.

21. A downhole tool for setting an auxiliary tool, the downhole tool comprising:

a floating piston having a through passage;

a plug that blocks the through passage and the plug is removably attached to the floating piston; and a brace rod having an upstream arm having an external diameter equal to or smaller than an external diameter of a portion of the plug that contacts the upstream arm.

22. The tool of claim 21, further comprising:

a housing having a pressure chamber that is separated by the floating piston from a hydraulic chamber.

23. The tool of claim 22, wherein the through passage fluidly connects the pressure chamber to the hydraulic chamber.

24. The tool of claim 23, wherein the plug prevents a fluid to move from the pressure chamber to the hydraulic chamber or from the hydraulic chamber to the pressure chamber when the plug is attached to the floating piston.

25. The tool of claim 22, further comprising:

a block that closes an end of the housing, the block having a through conduit and a venting port.

26. The tool of claim 25, further comprising:

an insert placed inside the conduit of the block.

27. The tool of claim 26, wherein the brace rod has a longitudinal groove.

28. The tool of claim 27, wherein the groove is not in fluid communication with the venting port when the plug is attached to the floating piston.

29. The tool of claim 27, wherein the groove is in fluid communication with the venting port after the floating piston has pushed the brace rod towards the insert.

30. The tool of claim 27, further comprising:

a cutting element attached to the insert for slicing an o-ring attached to the brace rod for opening the groove.

31. The tool of claim 21, wherein the plug shears off from the floating piston due to the brace rod.

* * * * *